US006585210B1

(12) United States Patent
Lee

(10) Patent No.: US 6,585,210 B1
(45) Date of Patent: Jul. 1, 2003

(54) SECURE PEN HOLDING MECHANISM

(75) Inventor: Ipson Lee, Taoyuan (TW)

(73) Assignee: Super Link Electronics Co., Ltd., Taoyuan (TW)

( * ) Notice: Subject to any disclaimer, the term of this patent is extended or adjusted under 35 U.S.C. 154(b) by 0 days.

(21) Appl. No.: 10/173,604

(22) Filed: Jun. 19, 2002

(51) Int. Cl.[7] ..... A47F 7/00

(52) U.S. Cl. ..... 248/314; 211/69.6; 248/311.2; 248/316.2

(58) Field of Search ..... 248/311.2, 314, 248/316.2, 309.1, 346.04, 111; 211/69.6; 15/443; 401/131, 88

(56) References Cited

U.S. PATENT DOCUMENTS 1,674,259 A * 6/1928 Palmer ..... 211/69.6
1,956,084 A * 4/1934 Tefft ..... 211/69.6
3,655,062 A * 4/1972 Curry ..... 211/69.6
4,501,358 A * 2/1985 Zinbarg ..... 206/371
5,361,461 A * 11/1994 Anscher ..... 24/115 G
5,484,052 A * 1/1996 Pawloski et al. ..... 198/867.05
5,671,505 A * 9/1997 Anscher ..... 24/115 G
5,839,712 A * 11/1998 Wang ..... 248/316.2
5,865,413 A * 2/1999 Niemann et al. ..... 248/314
5,897,090 A * 4/1999 Smith et al. ..... 248/311.2
6,386,496 B1 * 5/2002 Lai et al. ..... 248/309.1
6,435,749 B1 * 8/2002 Lecce ..... 401/131

* cited by examiner

*Primary Examiner*—Ramon O. Ramirez
*Assistant Examiner*—Tan Le
(74) *Attorney, Agent, or Firm*—Rosenberg, Klein & Lee

(57) ABSTRACT

Secure pen holding mechanism including a seat body formed with a slide socket, a resilient locating latch hook bottom end of which is inlaid in a wall of the slide socket and a holding body having a slide body and at least one resilient clamping arm. The slide body is slidably disposed in the slide socket of the seat body. A locating channel section is formed on outer face of a side wall of the slide body. A sliding end of the locating latch hook is slidable within the guide channels of the locating channel section so as to control and stop the slide body at different extending/retracting positions in the slide socket. The slide body is formed with a fitting cavity for accommodating a pen therein. The pen is clamped by the resilient clamping arm.

5 Claims, 7 Drawing Sheets

SECURE PEN HOLDING MECHANISM

BACKGROUND OF THE INVENTION

1. Field of the Invention

The present invention is related to a secure pen holding mechanism which keeps an accommodated pen in a held state. Accordingly, when taking out the pen, the pen is prevented from instantaneously bounding out.

2. Background of the Invention

FIGS. 9 and 10 show a conventional pen holding mechanism composed of a seat body 1, a slide collar 2, a holding member 3 and a resilient member 4. Two lateral sides of the seat body 1 are formed with resilient engaging sections 11. The inner side of the engaging section 11 has a projecting engaging hook 111. The center of the seat body 1 is formed with a receptacle 13 for receiving therein the holding member 3, the slide collar 2 and the resilient member 4. The slide collar 2 is formed with a central through hole 21 in which a restricting section 32 of the holding member 3 is fitted. The slide collar 2 is restricted between abutting sections 323 and engaging buckles 3211 of the holding member 3. An upper section of the holding member 3 is formed with two outward inclined resilient arms 31. The restricting section 32 is formed under the resilient arms 31. The abutting sections 323 outward project from the restricting section 32. The engaging buckles 3211 are formed under the restricting section 32 and have slopes. A stop end 3221 is formed at lower end of the holding member 3. The resilient member 4 is positioned between the restrict section 32 and the bottom of the receptacle 13. In cooperation with the engaging buckles and stop end of the holding member 3, the slide collar 2 can move and the engaging hook 111 of the engaging section 11 can be resiliently deformed, whereby the holding member 3 can reciprocally move within the seat body and the resilient arms 31 at top end of the holding member can tightly clamp a pen or release the pen.

In the above mechanism, the resilient arms 31 are open in a normal state without holding the pen 5. When releasing the pen 5, the holding member 3 is resiliently bounded upward. In the instant that the resilient arms 31 are opened, due to inertia, in case a user fails to catch the pen 5, the pen 5 will fly out in the bounding direction of the holding member 3. As a result, the pen 5 may drop onto the ground or hurt people.

SUMMARY OF THE INVENTION

It is therefore a primary object of the present invention to provide a secure pen holding mechanism including: a seat body formed with a slide socket inward extending from one end of the seat body, a wall of bottom section of the slide socket being formed with at least one stop wall, a locating latch hook being disposed in the slide socket; and a holding body including a slide body and at least one resilient clamping arm. The slide body is slidably disposed in the slide socket of the seat body. A locating channel section is formed on outer face of a side wall of the slide body. The locating latch hook of the seat body is hooked in the locating channel section to decide a stop position of the slide body in the slide socket. An outer end of the slide body is formed with an inward extending fitting cavity for a pen to insert therein. The resilient clamping arm is inlaid in the slide body and slidable within the slide socket of the seat body along with the slide body. In normal state, a clamping section of free end of the resilient clamping arm extends into the fitting cavity of the slide body to clamp and hold the inserted pen.

When the slide body is slidably positioned in the bottom section of the seat body, the outer side of the clamping arm is stopped by a stop wall of the slide socket from outward deflecting so as to securely tightly clamp and hold the pen.

The present invention can be best understood through the following description and accompanying drawings wherein:

DETAILED DESCRIPTION OF THE PREFERRED EMBODIMENTS

Figure 1:
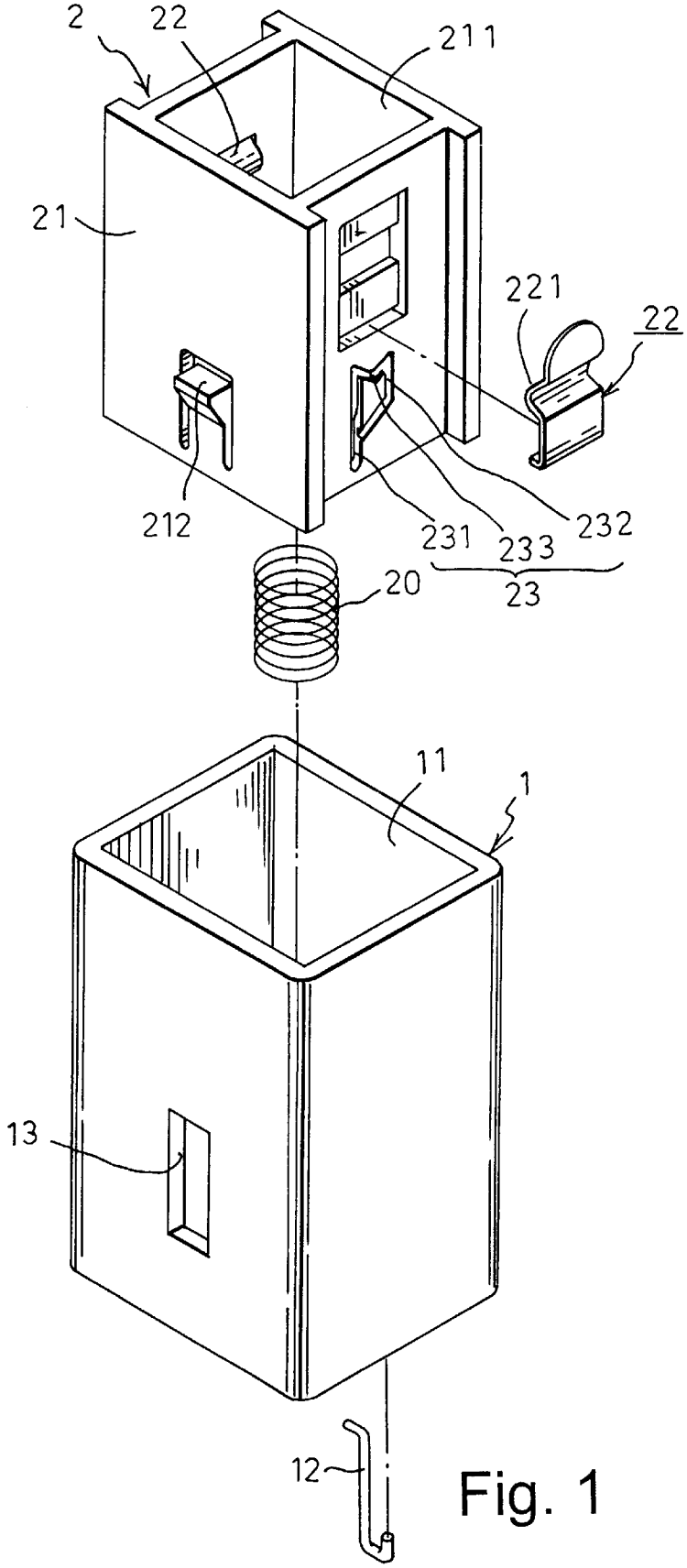
FIG. 1 is a perspective exploded view of the present invention.

Please refer to FIGS. 1 to 8. The secure pen holding mechanism of the present invention includes: a seat body 1 formed with a slide socket 11 inward extending from one end of the seat body 1, the wall of bottom section of the slide socket 11 being formed with at least one stop wall 111, a locating latch hook 12 being disposed in the slide socket 11; and a holding body 2 including a slide body 21 and at least one resilient clamping arm 22. The slide body 21 is slidably disposed in the slide socket 11 of the seat body. A spring 20 is compressed between the bottom end of the slide body 21 and the bottom board of the slide socket 11 of the seat body 1. In normal state, the spring 20 pushes the slide body 21 outward. A locating channel section 23 is formed on outer face of the wall of the slide body 21. The locating latch hook 12 of the seat body 1 is hooked in the locating channel section 23 to decide a stop position of the slide body 21 in the slide socket 11. The outer end of the slide body 21 is formed with an inward extending fitting cavity 211 for a pen P to insert therein. The resilient clamping arms 22 are inlaid in the slide body 21 and slidable within the slide socket 11 along with the slide body 21. In normal state, the clamping sections 221 of free ends of the resilient clamping arms 22 extend into the fitting cavity 211 of the slide body 21 to clamp and hold the inserted pen P. When the slide body 21 is slidably positioned in the bottom section of the seat body 1, the outer sides of the clamping arms 22 are stopped by the stop wall 111 of the slide socket 11 from outward deflecting. Therefore, the pen P is securely clamped and held.

Figure 2:
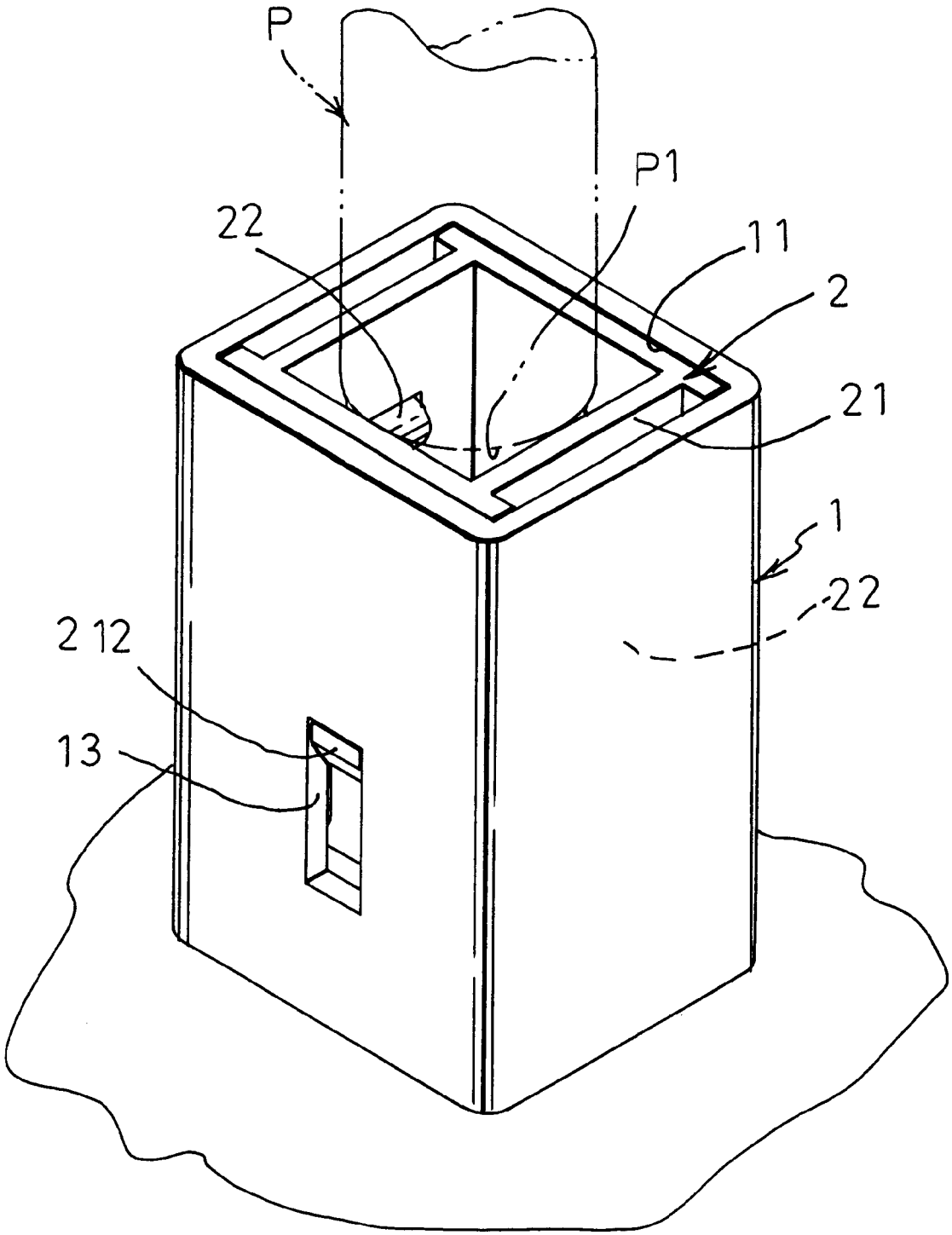
FIG. 2 is a perspective assembled view of the present invention.
Figure 3:
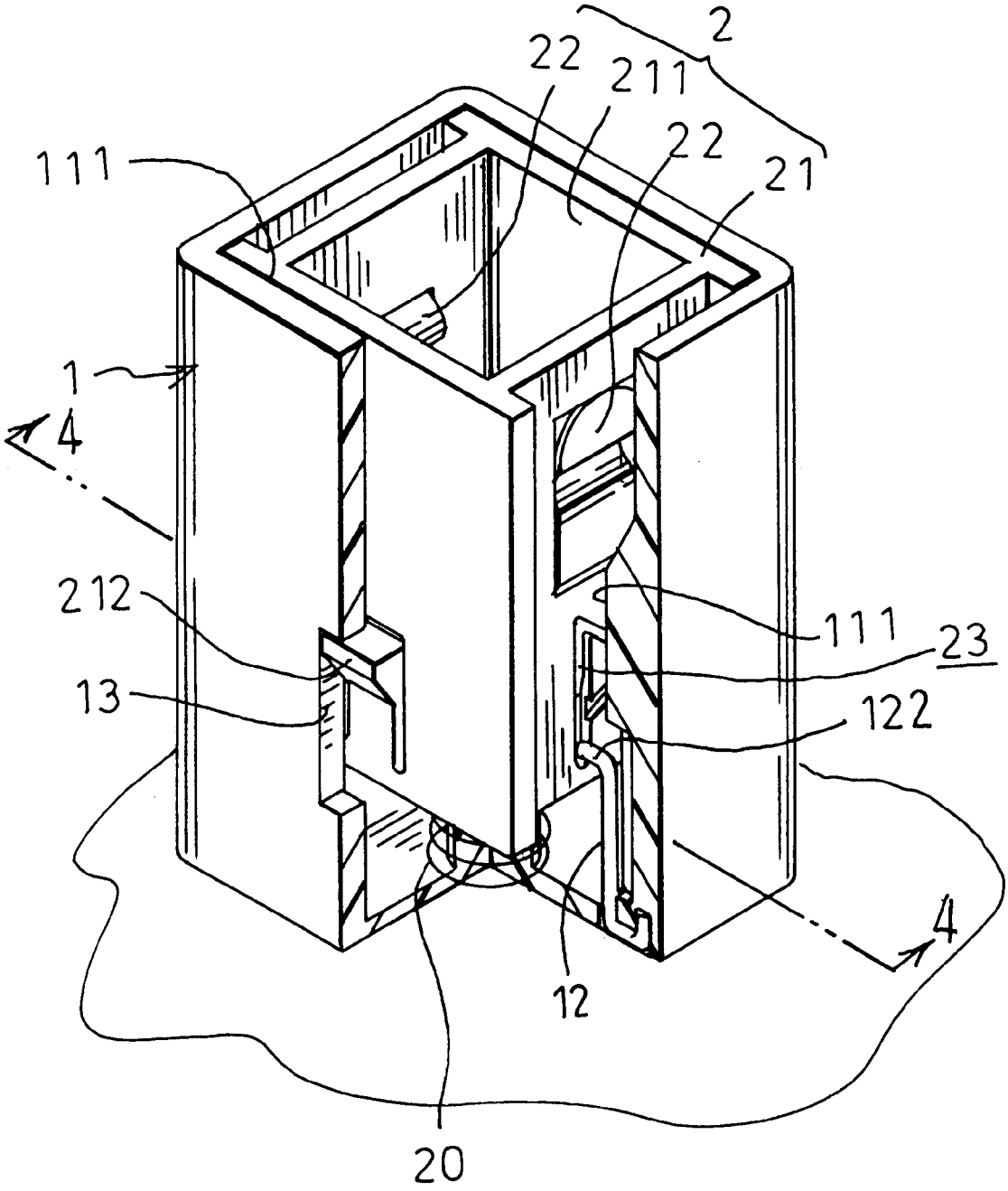
FIG. 3 is a partially sectional view of the present invention.

Please refer to FIGS. 1, 2 and 3. The seat body 1 can made of plastic material by integral molding. However, the present invention is not limited to this. The seat body 1 can be fixed on a desk face by double-face adhesive tape. Alternatively, the seat body 1 can be pivotally mounted on a pen holding unit of a personal digital assist (PDA) or any other device.

Figure 5:
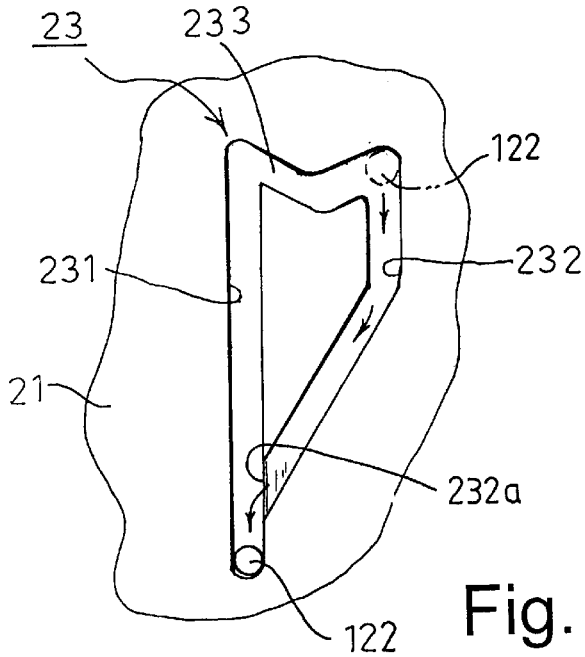
FIG. 5 shows the relationship between the locating channel section and the locating latch hook of the present invention in accordance with the state of FIG. 3.
Figure 7:
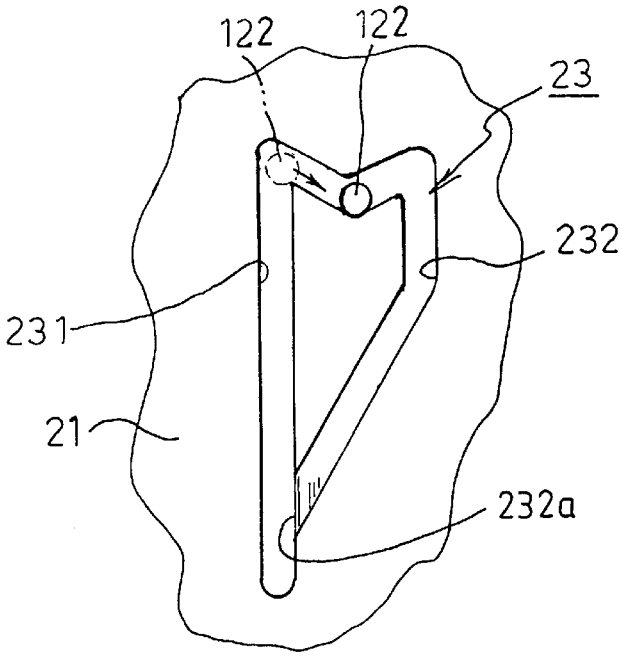
FIG. 7 shows the relationship between the locating channel section and the locating latch hook of the present invention in accordance with the state of FIG. 6.
Figure 8:
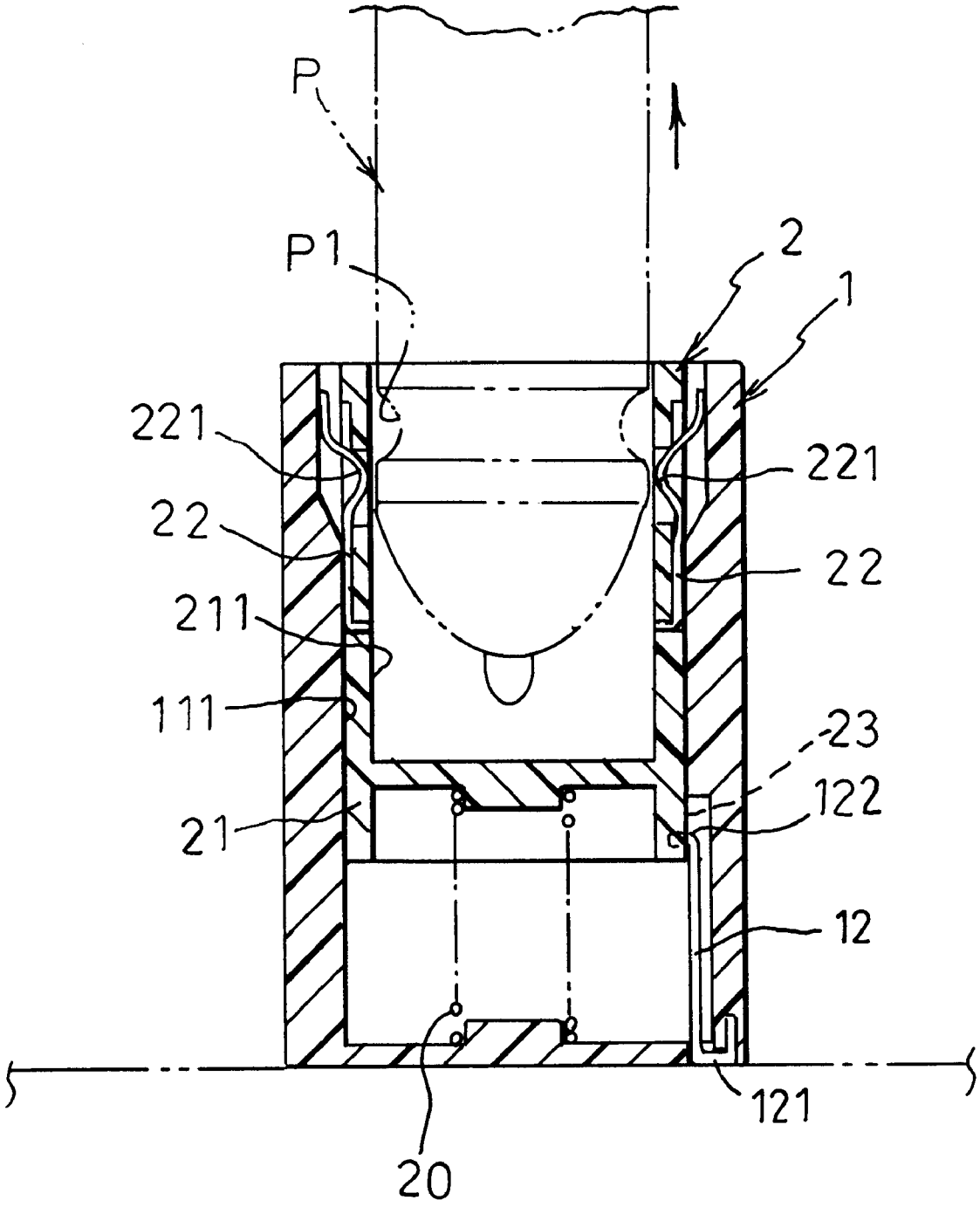
FIG. 8 is a sectional view showing that the pen is taken out from the present invention.
Figure 10:
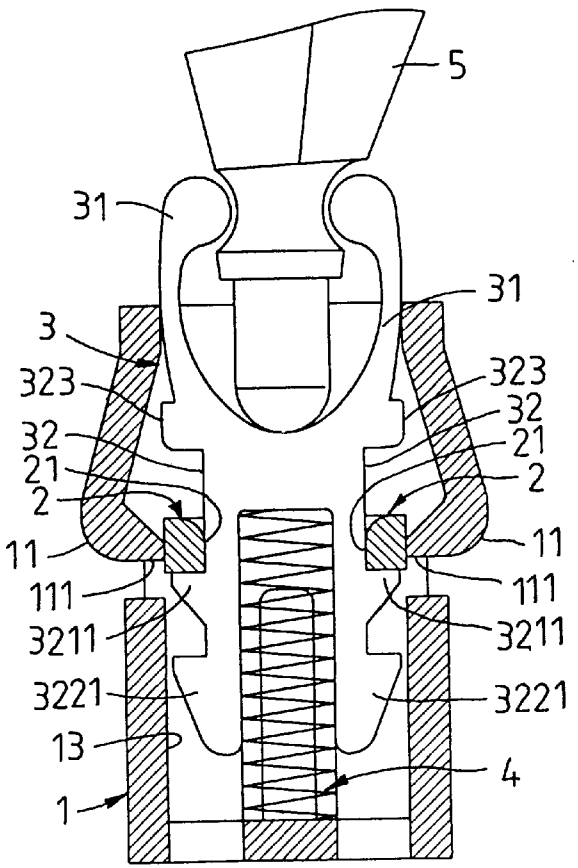
Fig. 10 PRIOR ART
FIG. 10 is a sectional view according to FIG. 9, showing that the pen is held by the conventional pen holding mechanism.
Figure 9:
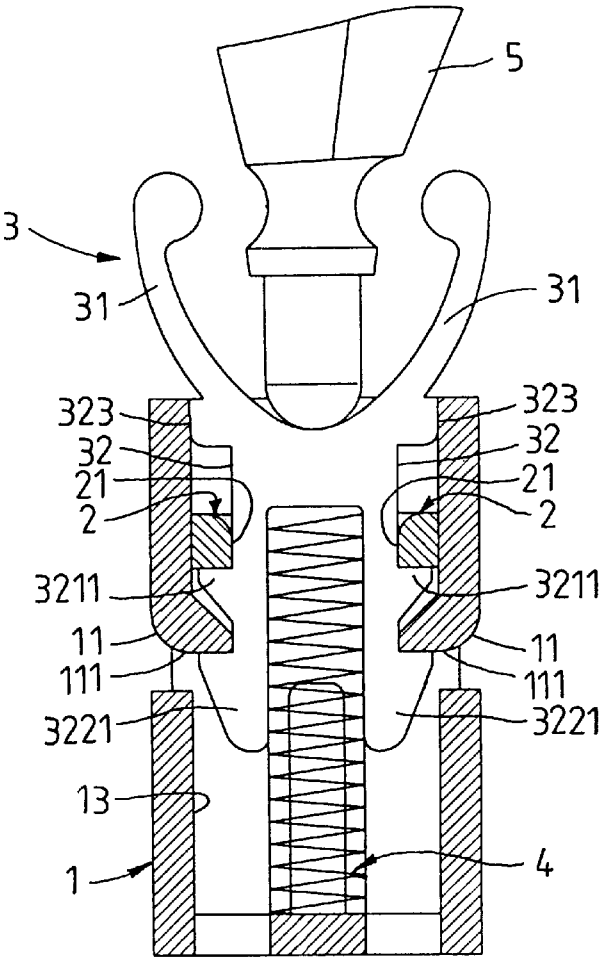
Fig. 9 PRIOR ART
FIG. 9 is a sectional view of a conventional pen holding mechanism, in which the pen is not yet held.

Referring to FIGS. 1, 5 and 7, the locating channel section 23 formed on the side wall of slide body 21 includes a first guide channel 231 and a second guide channel 232. The front sections of the first and second guide channels 231,232 are communicated with each other via a V-shaped guide channel 233. The bottom end of the second guide channel 232 obliquely connects with the first guide channel 231. When downward several times pushing the slide body 21, the locating latch hook 12 on the seat body relatively goes from the first guide channel 231 through the V-shaped guide channel 233 and the second guide channel 232 back to the first guide channel 231 to complete a cycle of operation.

The outlet of bottom end of the second guide channel 232 is formed with a stop shoulder 232*a* for stopping the locating latch hook 12 from entering the second guide channel 232 from the bottom end of the first guide channel 231. Accordingly, the cycle of operation can be sequentially performed. The outer face of the slide body 21 is provided with a stop block 212 which in normal state is slidably positioned in a locating window 13 of the seat body 1 for stopping the slide body 21 from bounding out of the slide socket 11 of the seat body 1.

Figure 6:
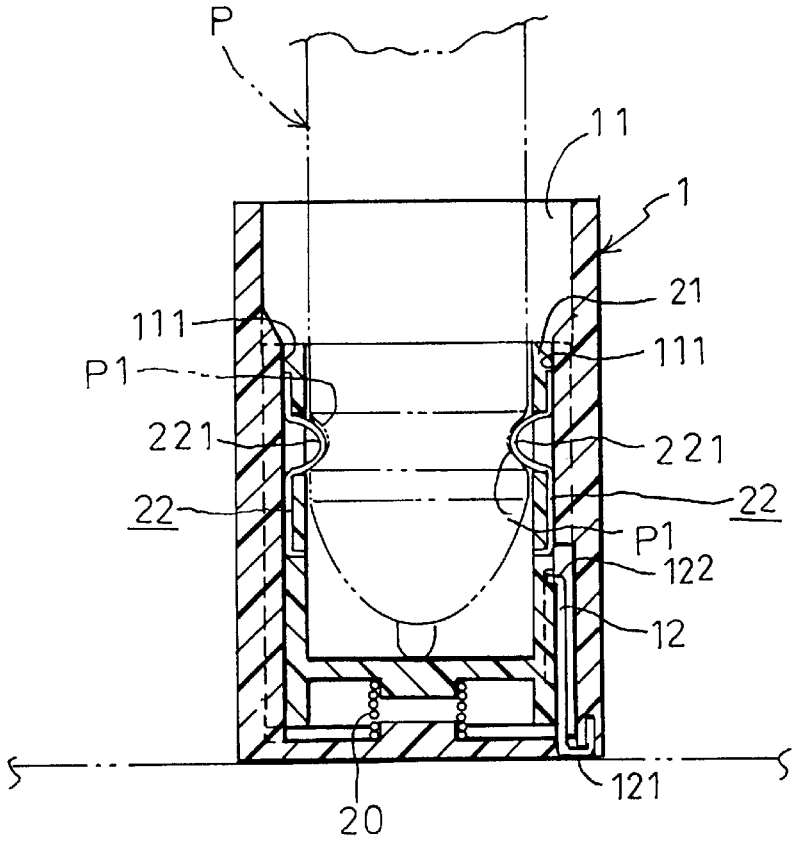
FIG. 6 is a sectional view according to FIG. 4, showing that the pen is securely clamped and held by the present invention.

Referring to FIGS. 1 to 5, when the clamping body 2 is positioned on top section of the seat body 1, the outer side of the clamping arm 22 is not stopped by the stop wall 111 of the slide socket of the seat body. Therefore, a user can insert a latched end of a pen P into the fitting cavity 211 of the slide body 21. Accordingly, the clamping section 221 of the clamping arm-22 is correspondingly latched in the latch groove P1 of the pen P. At this time, the locating latch hook 12 of the seat body is hooked in the bottom end of the first guide channel 231 of the locating channel section 23 as shown in FIG. 5. When the user presses down the pen P, the slide body 21 is simultaneously pressed down to slide to the bottom section of the slide socket 11 as shown in FIGS. 6 and 7. At this time, the outer side of the clamping arm 22 is stopped by the stop wall 111 of the slide socket from outward deflecting. Accordingly, the pen P is securely tightly clamped and held. At the same time, the locating latch hook 12 of the seat body is relatively moved along the first guide channel 231 into the middle portion of the V-shaped guide channel 233 so as to stably locate the slide body 21 in the bottom section of the slide socket 11 of the seat body.

Figure 4:
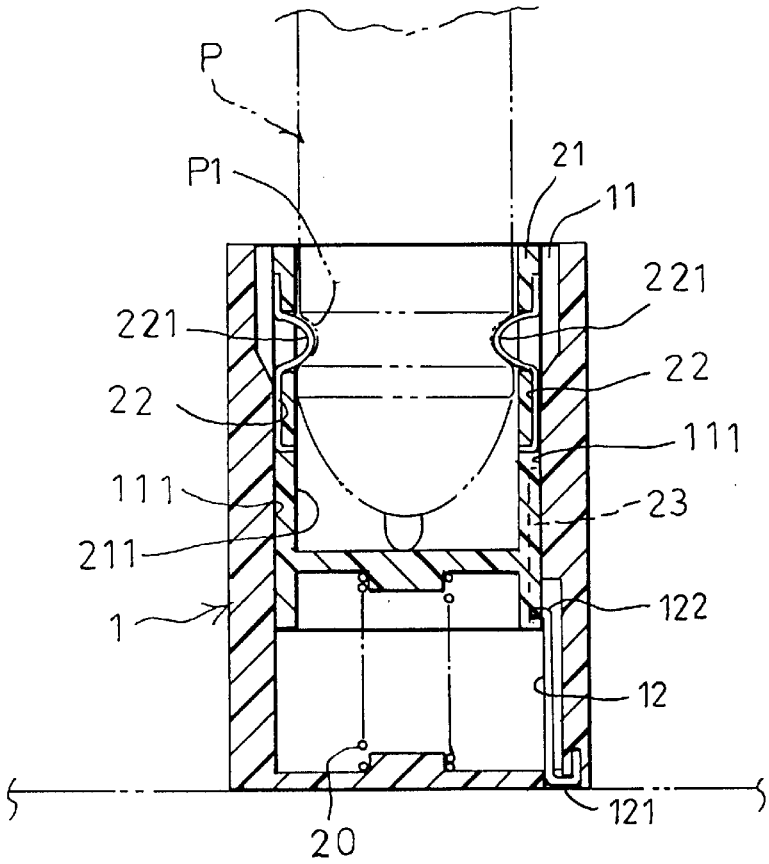
FIG. 4 is a sectional view taken along line 4—4 of FIG. 3.

Referring to FIGS. 3 and 4, the bottom end 121 of the locating latch hook 12 is fixedly inlaid in the seat body 1. The upper end of the latch hook 12 is a sliding end 122 which provides a clockwise resiliently pressing force. Accordingly, as shown in FIG. 5, after the sliding end 122 is mounted into the first guide channel 231, the resilience of the latch hook 12 makes the sliding end 122 rightly abut against the right wall of the first guide channel 231. Referring to FIG. 7, when the sliding end 122 of the latch hook 12 slides to the rear end of the first guide channel 231 (top end thereof in FIG. 7), the rightward resiliently deflecting force of the latch hook 12 easily forces the sliding end 122 to slide into the V-shaped guide channel 233. Referring to FIG. 5, when the rightward resiliently deflecting force of the latch hook 12 forces the sliding end 122 to slide to the rightmost end of the V-shaped guide channel 233, the spring 20 as shown in FIG. 4 forces the slide body 21 to slide upward along the slide socket 11. Relatively, the sliding end 122 of the latch hook 12 downward slides along the second guide channel 232 to the bottom end thereof. The stop shoulder 232*a* at the outlet of bottom end of the second guide channel 232 serves to stop the latch hook 12 from mis-entering the second guide channel 232 from the bottom end of the first guide channel 231. Accordingly, the sliding end 122 of the latch hook 12 is stopped by the stop shoulder 232*a* from directly entering the second guide channel 232 from the first guide channel 231.

When the user desires to release the pen P, the user can again press down the pen P from the position of FIGS. 6 and 7. At the same time, the slide body 21 is moved downward, making the latch hook 12 relatively move along the V-shaped guide channel 233 to the inlet end of the second guide channel 232 (as shown by phantom line of FIG. 5). At this time, the user only needs to release the pen P from the pressing force, permitting the spring 20 between the slide body 21 and the seat body 1 to bound and move the slide body 21 upward. At this time, the locating latch hook 12 relatively moves along the second guide channel 232 to the first guide channel 231 and restores to the state of FIGS. 3, 4 and 5. Under such circumstance, the stop wall 111 of the slide socket 11 no more abuts against the outer side of the resilient clamping arm 22 so that the clamping arm 22 can resiliently outward deflect. At this time, the user can directly take out the pen P. During the upward sliding procedure of the slide body 21, the pen P is kept held by the resilient clamping arms 22 so that the pen P is prevented from flying out. Therefore, the safety is ensured.

Alternatively, the locating latch hook 12 can be integrally formed with the seat body. Also alternatively, the resilient clamping arm 22 can be integrally formed with the slide body 21.

The above embodiments are only used to illustrate the present invention, not intended to limit the scope thereof. Many modifications of the above embodiments can be made without departing from the spirit of the present invention.

What is claimed is:

1. A secure pen holding mechanism comprising:

a seat body formed with a slide socket inward extending from one end of the seat body, a wall of bottom section of the slide socket being formed with at least one stop wall, a locating latch hook being disposed in the slide socket; and a holding body including a slide body and at least one resilient clamping arm, the slide body being slidably disposed in the slide socket of the seat body, a spring being compressed between a bottom end of the slide body and a bottom board of the slide socket of the seat body, in normal state, the spring pushing the slide body outward, a locating channel section being formed on outer face of a side wall of the slide body, the locating latch hook of the seat body being hooked in the locating channel section to decide a stop position of the slide body in the slide socket, an outer end of the slide body being formed with an inward extending fitting cavity for a pen to insert therein, the resilient clamping arm being inlaid in the slide body and slidable within the slide socket of the seat body along with the slide body, in normal state, a clamping section of free end of the resilient clamping arm extending into the fitting cavity of the slide body to clamp and hold the inserted pen, whereby when the slide body is slidably positioned in the bottom section of the seat body, outer side of the clamping arm is stopped by a stop wall of the slide socket from outward deflecting so as to securely tightly clamp and hold the pen.

2. The secure pen holding mechanism as claimed in claim 1, wherein the locating channel section formed on the side wall of slide body includes a first guide channel, a V-shaped guide channel and a second guide channel, front sections of the first and second guide channels being communicated with each other via the V-shaped guide channel, a bottom end of the second guide channel obliquely connecting with the first guide channel, an outlet of bottom end of the second guide channel being formed with a stop shoulder for stopping the locating latch hook from entering the second guide channel from the bottom end of the first guide channel.

3. The secure pen holding mechanism as claimed in claim 1, wherein an outer face of the slide body is provided with a stop block which in normal state is slidably positioned in a locating window of the seat body for stopping the slide body from bounding out of the slide socket of the seat body.

4. The secure pen holding mechanism as claimed in claim 1, wherein the locating latch hook is integrally formed with the seat body.

5. The secure pen holding mechanism as claimed in claim 1, wherein the resilient clamping arm is integrally formed with the slide body.

* * * * *